US006206749B1

(12) United States Patent
Bell

(10) Patent No.: US 6,206,749 B1
(45) Date of Patent: Mar. 27, 2001

(54) YO-YO

(76) Inventor: Dale L. Bell, 6461 Garden Rd., Riviera Beach, FL (US) 33404

( * ) Notice: Subject to any disclaimer, the term of this patent is extended or adjusted under 35 U.S.C. 154(b) by 0 days.

(21) Appl. No.: 09/512,695

(22) Filed: Feb. 24, 2000

(51) Int. Cl.[7] ..... A63H 1/30
(52) U.S. Cl. ..... 446/250
(58) Field of Search ..... 446/247, 248, 446/250, 251, 252

(56) References Cited

U.S. PATENT DOCUMENTS

| | | | | |
|---|---|---|---|---|
| 179,377 | | 6/1876 | Weber . | |
| 2,579,022 | | 12/1951 | Spencer . | |
| 2,891,351 | | 6/1959 | Madaras . | |
| 3,175,326 | | 3/1965 | Isaacson . | |
| 3,805,443 | | 4/1974 | Duncan . | |
| 3,834,069 | * | 9/1974 | Brown . | |
| 3,953,936 | | 5/1976 | Ennis . | |
| 4,130,962 | | 12/1978 | Ennis . | |
| 4,332,102 | | 6/1982 | Caffrey . | |
| 4,442,625 | | 4/1984 | MacCarthy . | |
| 4,895,547 | | 1/1990 | Amaral . | |
| 5,100,361 | | 3/1992 | Kuhn et al. . | |
| 5,769,686 | | 6/1998 | Duncan et al. . | |
| 5,813,898 | * | 9/1998 | Van Dan Elzen et al. | 446/250 |
| 5,984,759 | * | 11/1999 | O'Sullivan | 446/250 |
| 6,080,035 | * | 6/2000 | Pekarsky et al. | 446/250 |
| 6,113,456 | * | 9/2000 | Hadzicki et al. | 446/250 |
| 6,142,850 | * | 11/2000 | Levy | 446/250 |

* cited by examiner

*Primary Examiner*—Jacob K. Ackun, Jr.
*Assistant Examiner*—Jeffrey D. Carlson
(74) *Attorney, Agent, or Firm*—Charles J. Prescott

(57) ABSTRACT

A yo-yo including a pair of yo-yo body halves each formed as a composite having an inner hub, a central preferably dish-shaped main body portion defining an inward facing surface and an annular-shaped peripheral body portion. An axle is threadably engaged at each end thereof into a hub thread formed into each hub along an axis of rotation of the yo-yo. Each hub also includes a shoulder positioned radially adjacent the hub thread which, when the axle is fully tightened in frictional engagement into each hub thread by tightening rotation between the body halves, bear against one another to define a minimum gap between the inward facing surfaces of the body halves. A miniature bearing is also provided having an inner ring tightly frictionally engaged over each shoulder, each end of the bearing extending into an annular recess formed into each inward facing surface adjacent to the hub to maintain a tether in wrapped engagement around an outer ring of the bearing. The outer ring is freely rotatable with respect to the body halves and the axle, the axle rotating with the body halves when the yo-yo is spinning. The axle, when the body halves are forcibly rotated in an axle disengaging direction one to another, causes a corresponding increase in the width of the gap. Each inner facing surface is preferably arcuately shaped whereby the gap very gradually increases in width in a direction radially outwardly from the outer ring.

11 Claims, 1 Drawing Sheet

YO-YO

BACKGROUND OF THE INVENTION

1. Scope of Invention

This invention relates generally to the field of yo-yos, and more particularly to a yo-yo which includes a miniature ball bearing in combination with a unique hub structure and peripheral weighting of the yo-yo for enhanced performance.

2. Prior Art

Yo-yos have remained popular as an amusement toy for well over a century. A very early patent invented by Weber in U.S. Pat. No. 179,377 discloses one of the earliest of these entertainment devices. Another early yo-yo patent which also serves as a spinning top is disclosed in U.S. Pat. No. 2,579,022 invented by Spencer et al.

Yo-yos under the trademark DUNCAN have also been popular for almost a half century. One such patent is disclosed in U.S. Pat. No. 3,805,443 teaching a yo-yo with a maximum weight distribution at the outer periphery of the yo-yo body. A more recent Duncan invention having an improved axle and insert retainer is disclosed in U.S. Pat. No. 5,769,686.

In U.S. Pat. No. 4,895,547, Amaral has invented a high performance yo-yo with extended "sleep" features for extended trick performing time as therein disclosed. This is accomplished by a uniquely configured central spool which is mounted for free rotation on an axle active in a fashion similar to a ball bearing due to its low friction polymeric material. Kuhn, in U.S. Pat. No. 5,100,361, teaches very complex hub/bearing/thread adjusters for enhanced spinning operation and infinite gap adjustment.

The present invention provides a unique ball bearing hub structure and uniquely peripherally weighted yo-yo halves for an improved yo-yo which performs the "sleep" operation, quickly responds in retrieval movement and is generally smoother and having longer rotational inertia features than other designs known to applicant.

BRIEF SUMMARY OF THE INVENTION

This invention is directed to a yo-yo including a pair of yo-yo body halves each formed as a composite having an inner hub, a central dish-shaped main body portion defining an inward facing surface and an annular-shaped peripheral body portion. An axle is threadably engaged at each end thereof into a hub thread formed into each hub along an axis of rotation of the yo-yo. Each hub also includes a shoulder positioned radially adjacent the hub thread which, when the axle is fully tightened in frictional engagement into each hub thread by tightening rotation between the body halves, bear against one another to define a minimum gap between the inward facing surfaces of the body halves. A miniature bearing is also provided having an inner ring tightly frictionally engaged over each shoulder, each end of the bearing extending into an annular recess formed into each inward facing surface adjacent to the hub to maintain a tether in wrapped engagement around an outer ring of the bearing. The outer ring is freely rotatable with respect to the body halves and the axle, the axle rotating with the body halves when the yo-yo is spinning. The axle, when the body halves are forcibly rotated in an axle disengaging direction one to another, causes a corresponding increase in the width of the gap. Each inner facing surface is preferably arcuately shaped whereby the gap very gradually increases in width in a direction radially outwardly from the outer ring.

It is therefore an object of this invention to provide an improved yo-yo with enhanced smoothness and extended rotational inertia characteristics.

It is another object of this invention to provide an improved yo-yo utilizing a miniature ball bearing in association with a unique hub structure to provide adjustability of gap between the yo-yo halves without sacrificing full features and enhanced functionality.

It is still another object of this invention to provide an improved yo-yo with substantially superior rotational inertia benefits associated with enhanced peripheral density characteristics without substantial additional overall yo-yo weight.

Yet another object of this invention is to provide an improved yo-yo with unique arcuately configured inner faces of each yo-yo half which enhance overall yo-yo performance in association with a miniature precision ball bearing hub arrangement.

Still another object of this invention is to provide an improved yo-yo which lends itself to the ability to achieve greater precision in balancing each of the yo-yo halves before assembly so that, when assembled, the yo-yo will reflect this same degree of precision balance about the rotational axis of the yo-yo.

In accordance with these and other objects which will become apparent hereinafter, the instant invention will now be described with reference to the accompanying drawings.

DETAILED DESCRIPTION OF THE INVENTION

Figure 1:
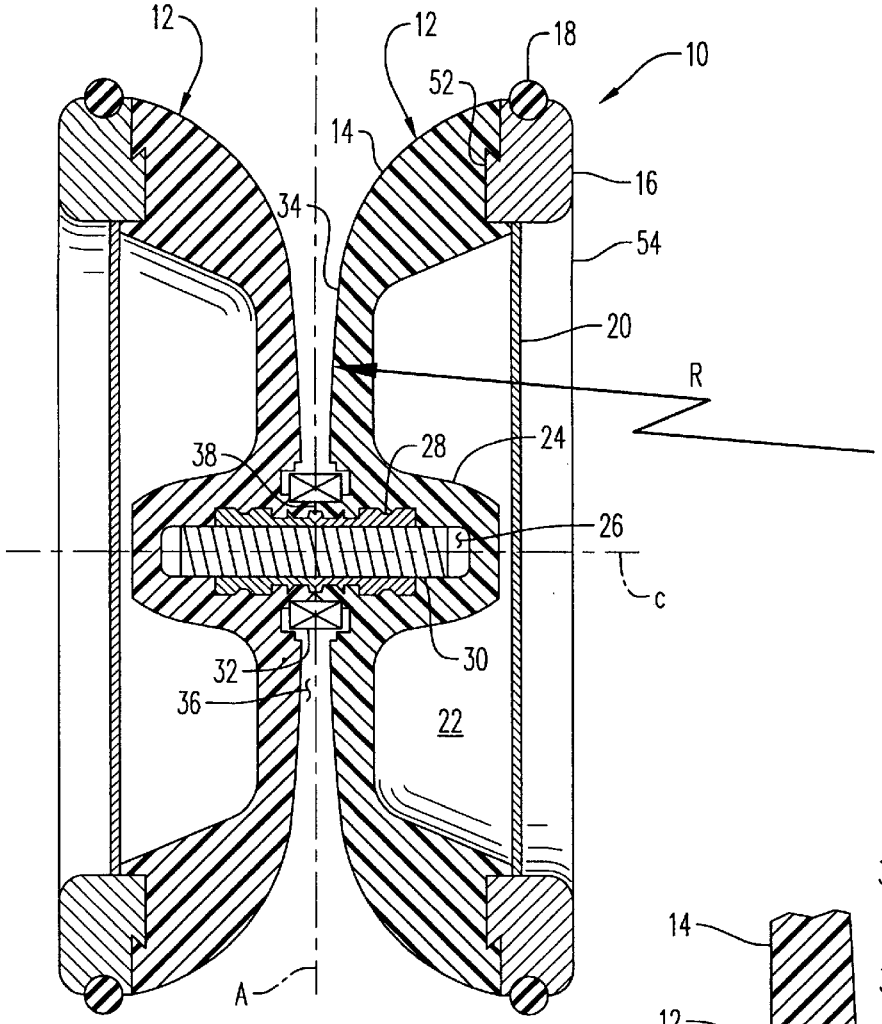
FIG. 1 is a section view of the improved yo-yo of the present invention.

Referring now to the drawings, the improved yo-yo of the present invention is shown generally at numeral 10. This yo-yo 10 includes identical yo-yo halves 12 each of which are formed of a central dish-shaped main body 14 of molded plastic material. Threaded brass hub inserts 28 are integrally molded with an enlarged molded plastic hub portion 24 so that the female threads 46 of each hub insert 28 are axially aligned along the axis of rotation C of the yo-yo 10.

An elongated threaded axle 30 is threadably engaged into each of the brass hub inserts 28 so that, when fully threadably engaged as shown in FIG. 1, the distal ends of the axle 30 preferably do not bottom out against the end or bottom of cavity 26 within each hub portion 24.

Figure 2:
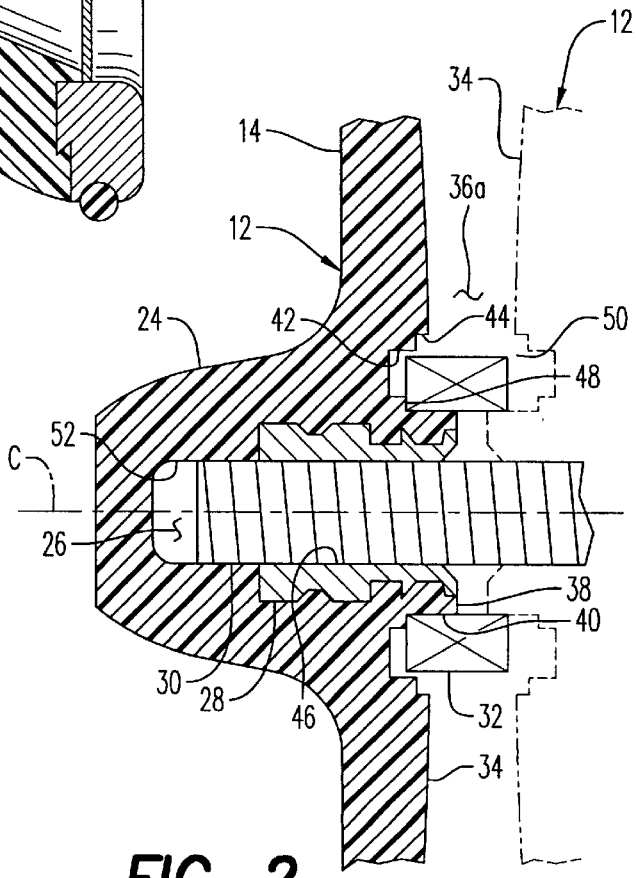
FIG. 2 is an enlarged section view of the hub area of the invention in FIG. 1 showing one of the yo-yo halves in phantom for clarity.

As best seen in FIG. 2, the unique overall hub structure of the present invention is there shown. A shoulder 38 is formed immediately radially adjacent the hub insert 28. The shoulder 38 of each main body portion 14 extends longitudinally to the axis C beyond an inward facing surface 34 of each of the yo-yo main body portions 14. Thus, when the threaded axle 30 is fully engaged as shown in FIG. 1, the shoulders 38 abut one another about a central plane A transverse to the rotational axis C of the yo-yo. By this arrangement of the abutting shoulders 38, a minimum gap 36 of approximately 0.07" as shown in FIG. 1 between the inward facing surfaces 34 is established.

A miniature precision ball bearing 32 is also provided. The inner ring of the ball bearing 32 is forcibly urged onto the cylindrical surface 40 which defines the shoulder 38. As best seen in FIG. 2, this cylindrical surface 40 extends inwardly with respect to each inward facing surface 34 so that, when the bearing 32 is fully engaged against lip 48, each end of the bearing 32 is substantially concealed so that the yo-yo string or tether wrapped around the outer ring of the bearing 32 cannot slip or be worked off of the outer surface of bearing 32.

The outer ring of the bearing 32 rotates freely due to the clearance provided with there at surface 42. A small annular notch 44 is also formed radially adjacent bearing clearance surface 42 which appears to provide the operational yo-yo function of interrupting the "sleep" mode of the yo-yo operation so as to allow for yo-yo retrieval and string receiving. The inward facing surface 34, as best seen in FIG. 1, is arcuate rather than flat or lying in the same plane as plane A. The preferred radius R of this arcuate surface 34 is eight inches.

It is postulated by applicant that the ability of the present invention to perform the "sleeping" yo-yo operation while still affording a very instant normal return of the yo-yo in rewinding along the string or tether back to the hand of the user is provided by either the arcuate contour of the inward facing surfaces 34 and/or the presence of the annular notch 44. Applicant has found that at least the arcuate configuration of the inward facing surfaces 34 are required to be present to effect this dual mode of yo-yo operation. However, it is again postulated that the preferred combination with the notch 44 may also be required to enhance complete yo-yo performance at heretofore unattainable level of yo-yo performance.

As seen in FIG. 2, the width of the gap 34*a* may be varied by simply disengaging the two yo-yo halves 12 from one another in very small increments by counterclockwise rotation one to another. As this occurs, the threads of one of the hub inserts 28 will disengage partially from the threaded hub axle 30 as demonstrated by the phantom outline of one of the two partially engaged yo-yo halves 12. This may increase the gap 36*a* substantially to alter the fashion in which the tether or yo-yo string is wound about the outer ring of bearing 32. However, as there shown in phantom in FIG. 2, the gap 36*a* is somewhat larger than desired and will likely result in the tether or yo-yo string slipping off of one end of the bearing 32 because the spacing 50 between one end of the outer ring of bearing 32 and the annular notch 48 is too great.

Applicant has found that the range of gap 36 or 36*a* is preferably in the range of 0.06" to 0.09". The preferred miniature ball bearing 32 has an outer diameter of 0.375", an inner diameter of 0.250" and a width of 0.125"and is available from National Precision Ball Bearing Corporation, Part number SSR1-614.

To insure that the yo-yo halves 12 do not rotate one to another when fully or partially engaged and interconnected by the threaded hub shaft 30, conventional tightening and locking means between the male and female threads of the hub shaft 30 and hub insert 28, respectively are provided by making the threaded hub shaft 30 sufficiently long so that the distal threads thereof screw into the unthreaded plastic halves themselves at 52.

Turning now to another aspect of the present invention 10, substantially increased rotational inertia of the present invention is provided by the annular shaped peripheral body portion 16. In the preferred embodiment, locking engagement is accomplished through the interlocking structure at 52 wherein the molded plastic main body portion 14 is integrally molded together with the peripheral body portion 16.

In the preferred embodiment, the peripheral body portion 16 is formed of metal, preferably aluminum. This has a substantially higher density than that of the plastic main body portion 14 which substantially increases the rotational inertia of the yo-yo 10 about the rotational axis C. Moreover, by forming the main body portion 14 into the dish-shaped configuration shown, a substantial amount of weight located closer to the rotational axis C, and less effective in providing rotational inertia, is eliminated. By this arrangement, the yo-yo 10 has a minimum amount of weight increase, if at all, and a maximum increase in the rotational inertia of the yo-yo 10 to substantially increase spin time and gyroscopic stability.

Moreover, by spacing the peripheral body portions 16 at a maximum distance from the central plane A of the yo-yo 10, the gyroscopic or stabilizing effect from wobbling is further maximized as well. Thus, the laterally outward surfaces 54 of each of the body halves 12 are preferably furthest from the central plane A and establish the maximum width of the yo-yo 10.

However, in an alternate embodiment, the peripheral body portion may be relocated substantially inward toward the rotational axis C which will have an opposite effect, i.e. to reduce the rotational inertia of the yo-yo for certain kinds of tricks and maneuvers which benefit from this alternate feature.

Annular elastomeric o-rings 18 are further provided which fit into mating grooves circumferentially formed in the radially outward surface of each peripheral body portion 16. These elastic rubber o-rings 18 serve two functions. First, a common mode of use, when the yo-yo is sleeping is to "walk the dog" or to allow the yo-yo to gently touch the ground or hard surface so that frictional engagement with the ground drags the yo-yo along. In doing so, friction contact with the ground will abrade the radially outward peripheral surface of the yo-yo. The elastic o-rings 18 effect ground contact in this mode of use and not only serve as a replaceable abrasive element, but also increase the friction or grabbing effect with the ground to enhance the performance of this maneuver.

Additionally, the elastic o-rings 18 provide for better frictional engagement with the palm of the hand of the user so that, when the yo-yo 10 is thrown, a maximum spin effect is induced into the yo-yo as it leaves the user's hand grasp of the yo-yo.

A decorative indicia-bearing disc 20 is also provided which conceals the hub portion 24 and provides for a generally flat appearing surface of the outer side surfaces of the yo-yo 10. These decorative discs 20 are frictionally forcibly engaged into the position shown in FIG. 1.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A yo-yo comprising:

a pair of yo-yo body halves each formed as a composite having an inner hub, a central dish-shaped main body portion defining an inward facing surface and an annular-shaped peripheral body portion;

an axle threadably engaged at each end thereof into a hub thread formed into each said hub along an axis of rotation of said yo-yo;

each said hub including a shoulder radially adjacent said hub thread which, when said axle is fully tightened in frictional engagement into each said hub thread by tightening rotation between said body halves, bear against one another to define a minimum gap between said inward facing surfaces;

a bearing having an inner ring tightly frictionally engaged over each said shoulder, each end of said bearing extending into a recess formed into each said inward facing surface to maintain a tether in wrapped engagement around an outer ring of said bearing, said outer ring freely rotatable with respect to said body halves and said axle, said axle rotating with said body halves when said yo-yo is in use;

said axle, when said body halves are forcibly rotated in an axle disengaging direction one to another, causing a corresponding increase in the width of said gap;

each said inner facing surface arcuately shaped whereby said gap increases in width radially outwardly from said outer ring.

2. A yo-yo as set forth in claim 1, further comprising:

an annular ground-engaging elastic ring extending around the surface of each said peripheral body portion, said elastic ring replaceable when worn and enhancing frictional contact with the ground and a user's hand when said yo-yo is thrown.

3. A yo-yo as set forth in claim 2, wherein:

each said peripheral body portion is formed of material having a density substantially greater than that of said main body portion to provide substantially increased rotational inertia of said yo-yo.

4. A yo-yo as set forth in claim 3, wherein:

said peripheral body portions are spaced apart a distance substantially equal to a maximum width of said yo-yo.

5. A yo-yo comprising:

a pair of yo-yo body halves each formed as a composite having an inner hub, a central dish-shaped main body portion defining an inward facing surface and an annular-shaped peripheral body portion;

an axle threadably engaged at each end thereof into a hub thread formed into each said hub along an axis of rotation of said yo-yo;

each said hub including a shoulder radially adjacent said hub thread which, when said axle is fully tightened in frictional engagement into each said hub thread by tightening rotation between said body halves, bear against one another to define a minimum gap between said inward facing surfaces;

a bearing having an inner ring tightly frictionally engaged over each said shoulder, each end of said bearing extending into a recess formed into each said inward facing surface to maintain a tether in wrapped engagement around an outer ring of said bearing, said outer ring freely rotatable with respect to said body halves and said axle, said axle rotating with said body halves when said yo-yo is in use;

said axle, when said body halves are forcibly rotated in an axle disengaging direction one to another, causing a corresponding increase in the width of said gap;

each said inner facing surface arcuately shaped whereby said gap increases in width radially outwardly from said outer ring;

each said peripheral body portion formed of material having a weight density substantially higher than that of said body halves.

6. A yo-yo as set forth in claim 5, further comprising:

an annular ground-engaging elastic ring extending around the surface of each said peripheral body portion, said elastic ring replaceable when worn and enhancing frictional contact with the ground and a user's hand when said yo-yo is thrown.

7. A yo-yo as set forth in claim 6, wherein:

said peripheral body portions are spaced apart a distance substantially equal to a maximum width of said yo-yo.

8. A yo-yo comprising:

a pair of yo-yo body halves each formed as a composite having an inner hub, a central dish-shaped main body portion defining an inward facing surface and an annular-shaped peripheral body portion;

an axle threadably engaged at each end thereof into a hub thread formed into each said hub along an axis of rotation of said yo-yo;

each said hub including a shoulder radially adjacent said hub thread which, when said axle is fully tightened in frictional engagement into each said hub thread by tightening rotation between said body halves, bear against one another to define a minimum gap between said inward facing surfaces;

a bearing having an inner ring tightly frictionally engaged over each said shoulder, each end of said bearing extending into a recess formed into each said inward facing surface to maintain a tether in wrapped engagement around an outer ring of said bearing, said outer ring freely rotatable with respect to said body halves and said axle, said axle rotating with said body halves when said yo-yo is in use;

said axle, when said body halves are forcibly rotated in an axle disengaging direction one to another, causing a corresponding increase in the width of said gap;

each said inner facing surface arcuately shaped whereby said gap increases in width radially outwardly from said outer ring;

an annular groove formed into each said inward facing surface radially adjacent to said recess, each said groove, cooperatively acting with a tether wrapped around said bearing outer ring to selectively connect said bearing outer ring with said body halves.

9. A yo-yo as set forth in claim 8, further comprising:

an annular ground-engaging elastic ring extending around the surface of each said peripheral body portion, said elastic ring replaceable when worn and enhancing frictional contact with the ground and a user's hand when said yo-yo is thrown.

10. A yo-yo as set forth in claim 9, wherein:

each said peripheral body portion is formed of material having a density substantially greater than that of said main body portion to provide substantially increased rotational inertia of said yo-yo.

11. A yo-yo as set forth in claim 10, wherein:

said peripheral body portions are spaced apart a distance substantially equal to a maximum width of said yo-yo.

* * * * *